US006411317B1

(12) United States Patent
Fukuda

(10) Patent No.: US 6,411,317 B1
(45) Date of Patent: Jun. 25, 2002

(54) THERMOSENSITIVE COLOR PRINTING METHOD AND THERMOSENSITIVE COLOR PRINTER

(75) Inventor: Hiroshi Fukuda, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/634,498

(22) Filed: Aug. 8, 2000

(30) Foreign Application Priority Data

Aug. 11, 1999 (JP) ..... 11-227524

(51) Int. Cl.[7] ..... B41J 11/00
(52) U.S. Cl. ..... 347/173
(58) Field of Search ..... 347/171–173, 347/212, 186–187, 174, 175, 185, 197; 400/120.02, 120.03, 120.08, 120.13, 120.14, 124.11–12, 124.14, 124.29

(56) References Cited

U.S. PATENT DOCUMENTS 5,818,494 A * 10/1998 Sato ..... 347/173
6,037,961 A * 3/2000 Saito et al. ..... 347/185

FOREIGN PATENT DOCUMENTS

JP 10-291332 11/1998 ..... B41J/2/325
JP 411138878 A * 5/1999 ..... B41J/2/325

OTHER PUBLICATIONS

Patent Abstract of Japan 10291332 Nov. 4, 1998.

* cited by examiner

*Primary Examiner*—N. Le
*Assistant Examiner*—K. Feggins
(74) *Attorney, Agent, or Firm*—Sughrue Mion, PLLC

(57) ABSTRACT

While the recording paper is transported in a printing direction through between a thermal head and a platen roller, the thermal head sequentially records first to third color frames of a full-color image on first to third coloring layers of thermosensitive color recording paper in the same image recording area. After the full-color image is completely recorded, the recording paper is transported again through between the thermal head and the platen roller while being heated by the thermal head, for smoothing a protective layer that is formed on an obverse surface of the recording paper, thereby to improve the glossiness of the obverse surface of the recording paper. For the smoothing, a larger pressure is applied from the thermal head to the platen roller and thus the recording paper than that used for the printing. Also, the position of the thermal head during the smoothing is shifted relative to the platen roller to an upstream side from the position of the thermal head during the printing with respect the paper transporting direction for the smoothing.

16 Claims, 11 Drawing Sheets

THERMOSENSITIVE COLOR PRINTING METHOD AND THERMOSENSITIVE COLOR PRINTER

BACKGROUND OF THE INVENTION

1. Field of the Invention

The present invention relates to a thermosensitive color printing method and a thermosensitive color printer for printing a full-color image on thermosensitive color recording paper in a frame sequential fashion. More particularly, the present invention relates to a thermosensitive color printing method and a thermosensitive color printer which smooth the surface of the thermosensitive color recording paper after having an image recorded thereon.

2. Background Arts

In a thermosensitive color printer, thermosensitive color recording paper, hereinafter called simply the recording paper, is directly heated by a thermal head that is pressed onto the recording paper while the recording paper is transported. As the recording paper is heated, color dots are developed on the recording paper.

As shown in FIG. 14, the recording paper 10 has a thermosensitive cyan coloring layer 12, a thermosensitive magenta coloring layer 13, and a thermosensitive yellow coloring layer 14 formed atop another on one side of a base material 11. A transparent protective layer 15 is formed atop the thermosensitive coloring layers 12 to 14, for protecting the coloring layer 12 to 14 from scratches or stains. The sequence of forming these three coloring layers 12 to 14 is not limited to that shown in the drawings, and the three coloring layers 12 to 14 have different heat-sensitivities from each other that decrease with the depth or distance of the respective layers from an obverse surface 10*a* of the recording layer 10. Intermediate layers 16 and 17 are formed between these three coloring layers 12 to 14, for adjusting the heat-sensitivities of the respective coloring layers 12 to 14. A back protective layer 18 is formed on the opposite side of the base material 11 from the obverse protective layer 15.

In the recording paper 10 shown in FIG. 14, the cyan coloring layer 12 has the lowest heat-sensitivity and the yellow coloring layer 14 has the highest heat-sensitivity . Accordingly, as shown in FIG. 15, the yellow coloring layer 14 needs the smallest heat energy to develop yellow color, whereas the cyan coloring layer 12 needs the largest heat energy to develop cyan color. Because of the difference in heat-sensitivity between the three coloring layers 12 to 14, it is possible to record three color frames sequentially from the highest sensitive coloring layer to the lower sensitive coloring layer by applying increasing amounts of heat energy to the recording paper 10 from one color after another.

To stop the coloring layer from being developed unnecessarily by the heat energy applied for recording the next color frame, the coloring layer having a color frame recorded thereon is fixed by electromagnetic rays of a specific range before the next color frame is recorded. In the recording paper 10, the magenta coloring layer 13 has an absorption spectrum whose peak wavelength is at about 365 nm, and loses coloring ability when it is exposed to ultraviolet rays of this wavelength range. On the other hand, the yellow coloring layer 14 has an absorption spectrum whose peak wavelength is at about 420 nm, and loses coloring ability when it is exposed to violet visible light of this wavelength range. So the violet visible light of 420 nm is projected onto the recording paper 10 after the yellow frame is recorded, before the magenta frame is recorded. After recording the magenta frame, the ultraviolet rays of 365 nm is projected onto the recording paper 10 to fix the magenta coloring layer 13.

The protective layer 15 is made from a transparent heat resistant resin material. As well-known in the art, the heat resistant resin material starts to be softened above a glass transit point or temperature of the main component of the resin material. The glass transit point is different between different resin materials. For example, in a conventional thermosensitive color recording paper, PVA (poly-vinyl-alcohol) is used as the main component of the protective layer, whose glass transit temperature is about 70° C.

The thermal head has an array of glaze layers formed on a substrate, and a heating element is located around a peak of a semi-cylindrical glaze layer whose axis extends perpendicularly to the paper transporting direction. The heat energy applied to the recording paper for developing colors is so high that the protective layer is softened and the temperature of the protective layer of the heated portion can be still above its glass transit point even after the heated portion is removed from the glaze layer. In that case, additives contained in the protective layer, such as an anti-blocking agent, emerge to the obverse surface of the recording paper, providing irregular fine roughness on the obverse surface, that lessens the glossiness of the obverse surface, and coarsens the printed image.

To restore the glossiness of the recording paper after having an image recorded thereon, according to a conventional smoothing process, a flat smooth sheet is laid over the recording paper, and the recording paper is squeezed together with the flat smooth sheet through a pair of heating rollers, thereby to hot-press the recording paper. However, this conventional smoothing process needs a specific smoothing apparatus in addition to the printer, and the flat smooth sheet must be laid over the recording paper by hands. Moreover, it has been difficult to maintain the amount of heat energy applied from the heat rollers to the recording paper in a range suitable for smoothing.

To solve this problem, a smoothing method has been suggested in JPA 10-291332, wherein a second thermal head for smoothing is provided in addition to a thermal head for recording, so as to heat the recording paper uniformly by the second thermal head after three color frames are sequentially recorded by the first thermal head. This prior art also discloses a teaching to use the same thermal head for recording and smoothing.

However, optimum contacting conditions of the heating elements with the protective layer for smoothing are different from those optimum for recording. Where the contacting conditions of the heating elements are optimized for smoothing, printing quality or heating efficiency would be lowered. Where the contacting conditions of the heating elements are optimized for recording, the effect of smoothing would be insufficient. Especially, the smoothing effect increases with an increase in pressure from the heating elements to the recording paper, but large pressure on the recording paper would cause fluctuation in transport speed of the recording paper, and thus color failures between the tree color frames of one full-color image. Besides that, the larger the pressure of the heating elements on the recording paper, the sooner the thermal head will be worn out. Therefore, it has been difficult to achieve both adequate coloring quality and highest glossiness by using the same thermal head for recording and smoothing.

SUMMARY OF THE INVENTION

In view of the foregoing, an object of the present invention is to provide a color thermosensitive printing method and a thermosensitive color printer for printing a full-color image in a frame sequential fashion on thermosensitive color recording paper having a plurality of coloring layers formed on atop another and a heat resistant protective layer formed on an obverse surface, which method and printer can smooth the surface of the thermosensitive color recording paper adequately by use of the same thermal head as used for recording, while maintaining good coloring quality.

To achieve the above object, a thermosensitive color printing method of the present invention comprises the steps of:

A. recording different color frames of the full-color image line by line on the respective coloring layers sequentially from the obverse side by pressing an array of heating elements of a thermal head onto the obverse surface of the thermosensitive color recording paper and heating the recording paper by the heating elements while supporting the thermosensitive color recording paper from a reverse side by a platen member and transporting the recording paper through between the thermal head and the platen roller;

B. fixing an upper one of the coloring layers optically before recording on the next coloring layer by projecting rays of a specific wavelength range onto the thermosensitive recording paper;

C. transporting the thermosensitive color recording paper, after having the full-color image recorded thereon, while pressing the heating elements onto the obverse surface of the recording paper with a higher pressure than during the step A; and D. heating the thermosensitive color recording paper, during the step C, by the heating elements to an extent predetermined for smoothing the protective layer.

According to another aspect of the present invention, a thermosensitive color printing method of printing a full-color image in a frame sequential fashion on the thermosensitive color recording paper comprises the steps of:

A. recording different color frames of the full-color image line by line on the respective coloring layers sequentially from the obverse side by pressing an array of eating elements of a thermal head onto the obverse surface of the thermosensitive color recording paper and heating the recording paper by the heating elements while supporting the thermosensitive color recording paper from a reverse side by a platen roller and transporting the recording paper back and force along a paper transport path that extend perpendicularly to the array of heating elements;

B. fixing one color frame optically before recording the next color frame by projecting rays of a specific wavelength range onto the thermosensitive recording paper;

C. transporting the thermosensitive color recording paper, after having the full-color image recorded thereon, in one direction along the transport path while pressing the heating elements onto the obverse surface of the recording paper at a position that is shifted from a contact position of the heating elements in the step A relative to the platen roller, to an upstream side with respect to the paper transporting direction in the step C; and D. heating the thermosensitive color recording paper, during the step D, by the heating elements to an extent predetermined for smoothing the protective layer.

It is preferable to press the heating elements onto the obverse surface of the thermosensitive color recording paper with a higher pressure for smoothing than for recording, besides shifting the contact position of the heating elements for smoothing from the contact position for recording.

In a thermosensitive color printer for printing a full-color image on thermosensitive color recording paper having a plurality of coloring layers formed on atop another and a heat resistant protective layer formed on an obverse surface of the thermosensitive color recording paper, the coloring layers having decreasing heat-sensitivities from the obverse side to develop different colors from each other, wherein different color frames of the full-color image are recorded on the respective coloring layers sequentially from the obverse side by heating the recording paper and then fixing one color frame optically before recording the next color frame, the present invention is characterized by comprising:

a thermal head having an array of heating elements, the heating elements being pressed onto the obverse surface of the thermosensitive color recording paper to heat the recording paper;

a platen roller opposed to the array of heating elements, for supporting the recording paper from a reverse side;

a transporting device for transporting the thermosensitive color recording paper along a paper transport path that extends perpendicularly to the array of the heating elements;

a driving device for driving the heating elements to heat the thermosensitive color recording paper as it is transported along the paper transport path, for recording the full-color image and thereafter for smoothing the protective layer;

an optical fixing device for projecting optical fixing rays onto the thermosensitive recording paper;

a pressure changing device for changing pressure from the heating elements to the recording paper between a lower value for recording and a higher value for smoothing; and a contact position shifting device for shifting the position of the heating elements pressed on the recording paper between a first contact position and a second contact position that is located at an upstream side of the first position in the paper transporting direction during the smoothing.

BRIEF DESCRIPTION OF THE DRAWINGS

The above and other objects and advantages of the present invention will become apparent from the following detailed description of the preferred embodiments when read in connection with the accompanying drawings, which are given by way of illustration only and thus are not limiting the present invention, wherein like reference numerals designate like or corresponding parts throughout the several views, and wherein.

DETAILED DESCRIPTION OF THE PREFERRED EMBODIMENTS

Figure 1:
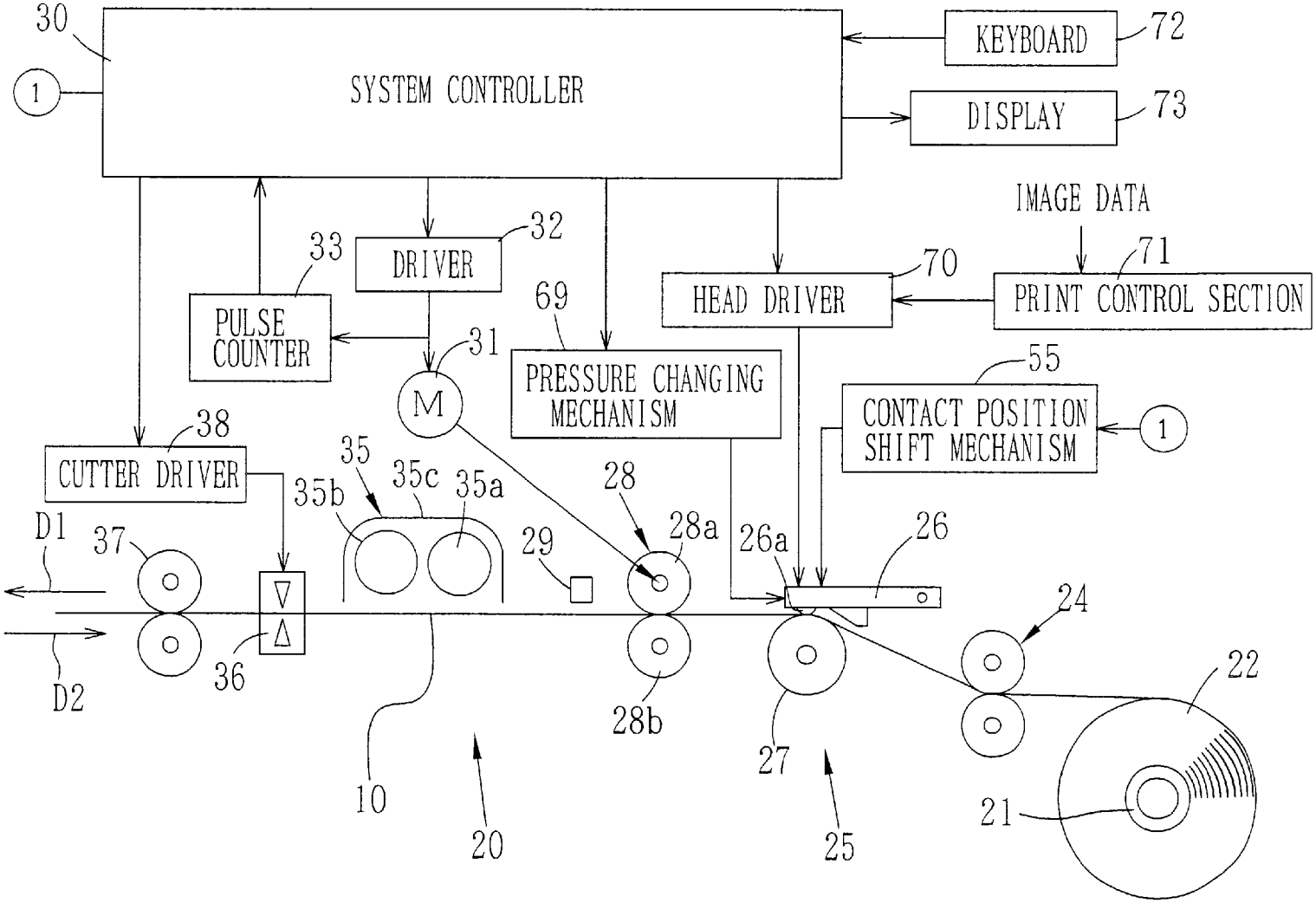
FIG. 1 is a schematic diagram illustrating a thermosensitive color printer according to a first embodiment of the invention.
Figure 14:
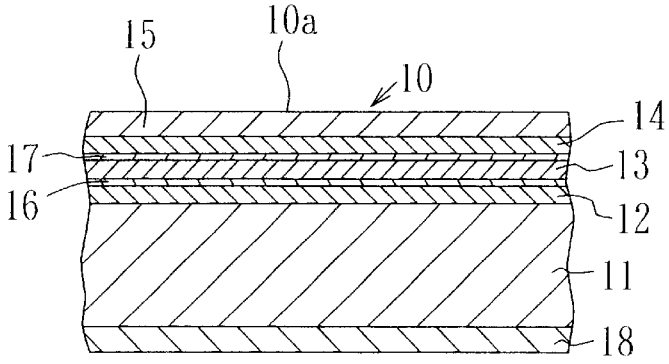
FIG. 14 (PRIOR ART)
FIG. 14 is an explanatory diagram illustrating a layered structure of the recording paper.
Figure 15:
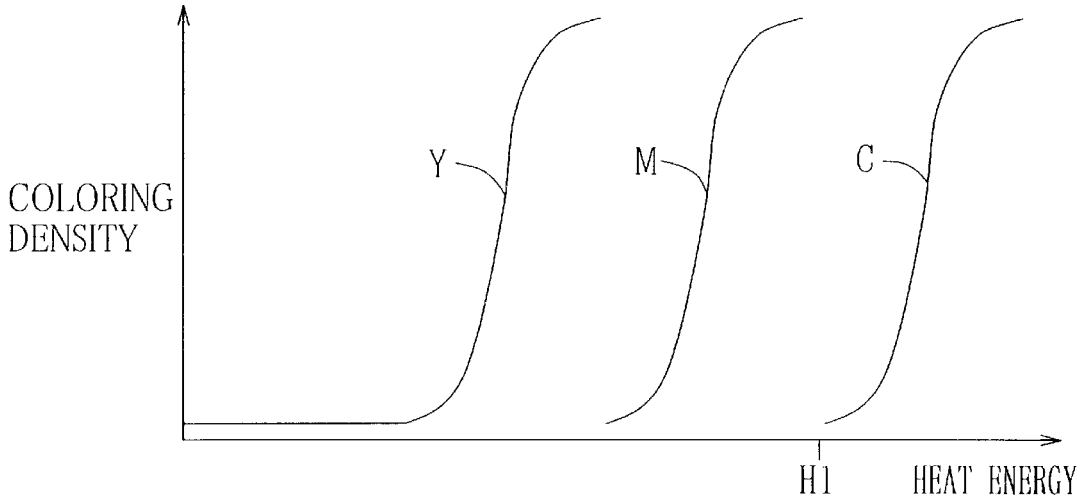
FIG. 15 (PRIOR ART)
FIG. 15 is a graph illustrating coloring characteristic of the recording paper.

In FIG. 1, recording paper 10 having the same structure as shown in FIG. 14 is coiled into a paper roll 22 around a spool 21, and is loaded in a thermosensitive color printer 20. A paper supply roller pair 24 nip the recording paper 10 and feed it out to a printing stage 25. In the printing stage 25, there are disposed a thermal head 26, a platen roller 27, and a feed roller pair 28 in this order from the paper supply roller pair 24. The thermal head 26 is provided with a heating element array 26*a* that is constituted of a large number of heating elements arranged in a line across a width of the recording paper 10. The platen roller 27 supports the recording paper 10 from the back side, while the heating element array 26*a* is pressed onto the obverse surface 10*a* of the recording paper 10.

The feed roller pair 28 consists of a capstan roller 28*a* and a nip roller 28*b*. The capstan roller 28*a* is driven to rotate by a pulse motor 31 that is controlled by a system controller 30 through a driver 32. Although it is not shown in the drawing, the pulse motor 31 is also used for rotating the paper supply roller pair 24. The pulse motor 31 can rotate in forward and reverse directions. When the pulse motor 31 rotates in the forward direction, the capstan roller 28*a* rotates in a clockwise direction in the drawings, so the recording paper 10 is transported in a printing direction as shown by an arrow D1, that is equal to the paper supply direction in this embodiment. While the recording paper 10 is transported in the printing direction D1, the thermal head 26 applies heat energy to the recording paper 10 to develop color dots thereon.

A pulse counter 33 counts the number of motor drive pulses applied to drive the pulse motor 31, so the system controller 30 determines the position of the recording paper 10 based on the count of the pulse counter 33. The pulse counter 33 counts up the motor drive pulses while the pulse motor 31 rotates forward, and counts down the motor drive pulses while the pulse motor 31 rotates reversely. By rotating the pulse motor 31 reversely, the capstan roller 28*a* rotates counterclockwise, feeding the recording paper in a returning direction D2 reverse to the printing direction D1.

The thermal head 26 is driven by a head driver 70 under the control of the system controller 30. A print control section 71 sends image data of one frame to the head driver 70 line by line synchronously with the paper movement in the printing direction D1, so a color frame is recorded line by line in an image recording area on the recording paper 10. Yellow, magenta and cyan color frames are sequentially recorded in the same image recording area to provide a full-color image.

Behind the feed roller pair 28 in the printing direction D1, there are disposed a paper sensor 29, an optical fixing device 35, a paper cutter 36 and a paper ejection roller pair 37 in this order from the feed roller pair 28. The optical fixing device 35 consists of a magenta fixing lamp 35*b*, a yellow fixing lamp 35*a* and a reflector 35*c*. The yellow fixing lamp 35*a* emits violet visible light having an emission peak at 420 nm. The magenta fixing lamp 35*b* emits ultraviolet rays having an emission peak at 365 nm.

The paper cutter 36 is driven by the system controller 30 through a cutter driver 38 to cut the image recording area having the full-color image recorded thereon off the recording paper 10. The system controller 30 is a well-known microcomputer, and is provided with a keyboard 72 for entering various commands or the like and a display 73 for displaying the entered commands and selected modes.

Figure 2:
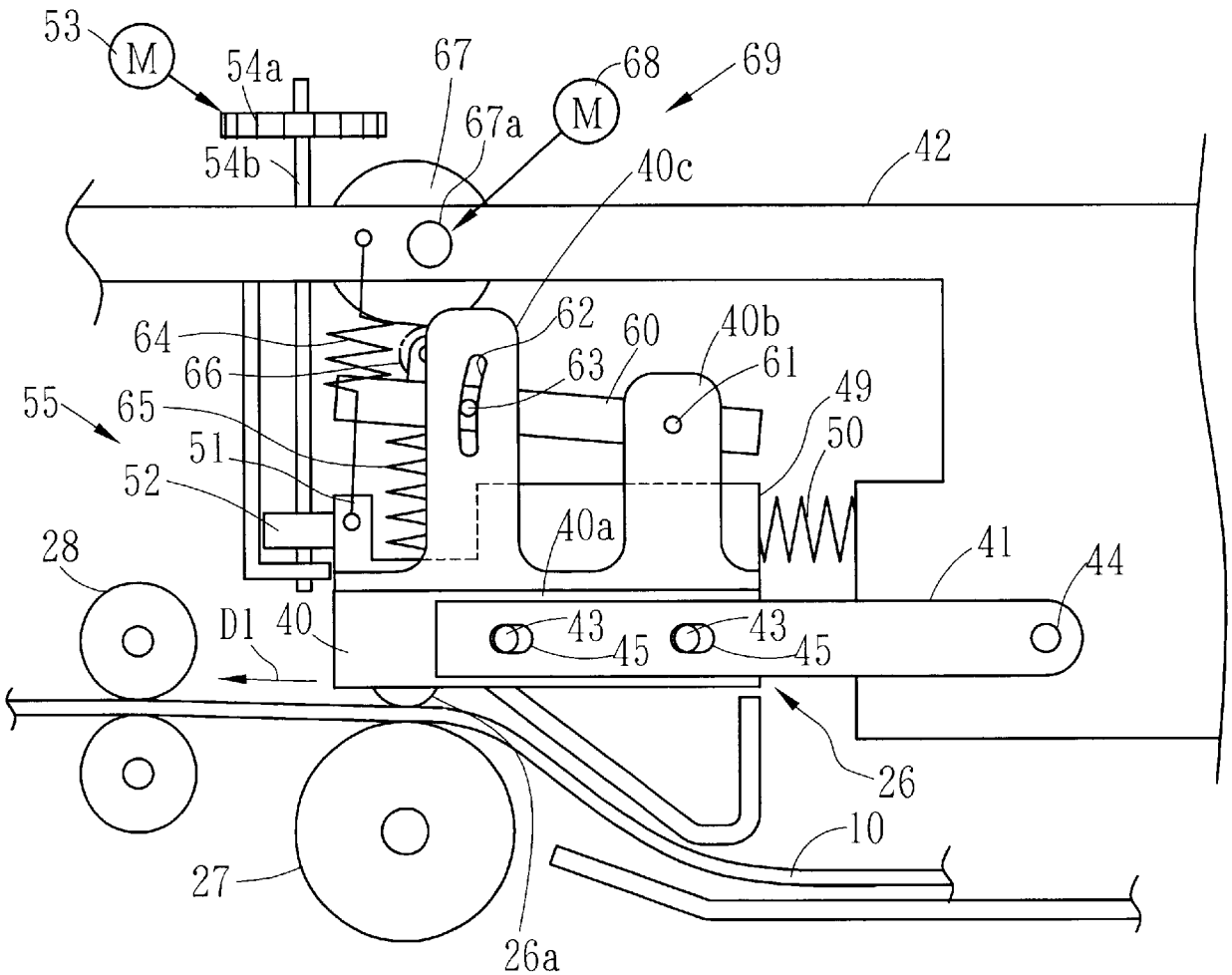
FIG. 2 is a side view illustrating a contact position shift mechanism of the thermosensitive color printer of the first embodiment, wherein a thermal head is in a printing position.
Figure 3:
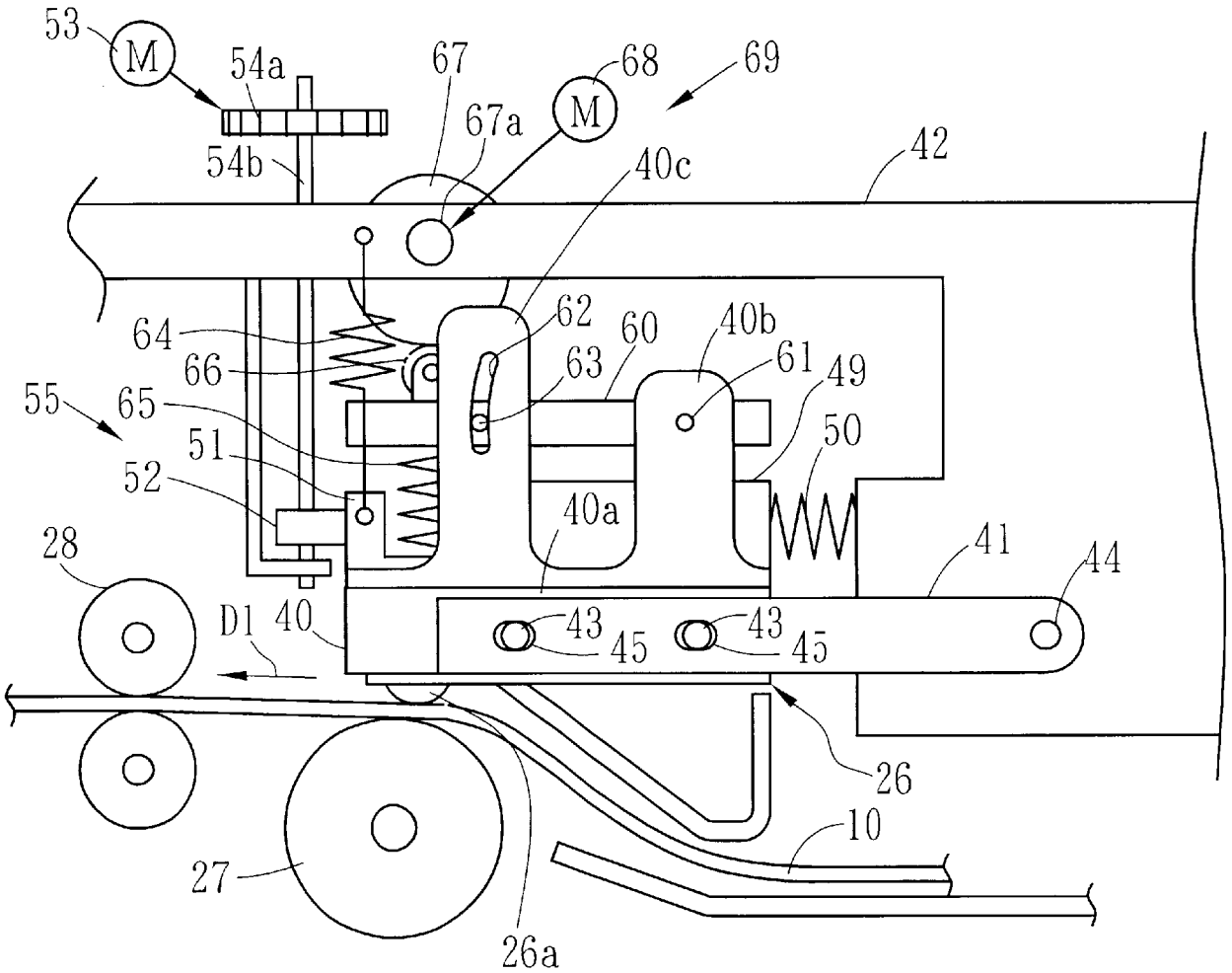
FIG. 3 is a similar view to FIG. 2, but showing another position of the contact position shift mechanism, wherein the thermal head is in a smoothing position.

As shown in FIGS. 2 and 3, the thermal head 26 is mounted to a printer frame 42 through a head mounting frame 40 and a head arm 41 such that the thermal head 26 is movable relative to the printer frame 42. Specifically, the thermal head 26 is secured to the head mounting frame 40 that is mounted to the head arm 41 through engagement between mounting axles 43 of the mounting frame 40 and slots 45 of the head arm 41. The mounting axles 43 protrude from a side plate 40*a* of the head mounting frame 40, whereas the slots 45 are elongated in a lengthwise direction of the head arm 41, so the head mounting frame 40 is movable in the lengthwise direction of the head arm 41. The head arm 41 is pivotally mounted to the printer frame 42 through an axle 44. In the positions shown in FIGS. 2 and 3, the head arm 41 extends in a horizontal direction that is substantially parallel to the recording paper 10 in the printing stage 25. Designated by 49 is a heat radiating fin formed on a top side of the thermal head 26.

A coiled spring 50 is held between the head mounting frame 40 and the printer frame 42, to urge the head mounting frame 40 to move to the left in FIG. 2, that corresponds to the printing direction D1. A cam follower plate 51 is formed on a left tip of the head mounting frame 40, and a horizontal position changing cam 52 is placed on the left of the cam follower plate 51. Because of the coiled spring 50, the cam follower plate 51 is kept in contact with the horizontal position changing cam 52. The horizontal position changing cam 52 is an eccentric cam whose rotary shaft 54*b* is rotated by a motor 53 through an interconnection gear 54*a* that is secured to the rotary shaft 54*b*. The horizontal position changing cam 52 is rotated intermittently by 180° degrees, so the head mounting frame 40 is switched between a first horizontal position shown in FIG. 2 and a second horizontal position shown in FIG. 3. The head mounting frame 40, the head arm 41, the coiled spring 50, the horizontal position changing cam 52 and the motor 53 constitute a contact position shift mechanism 55 for the thermal head 26.

A mounting bracket 40*b* and a holding bracket 40*c* are protruded upward from an upper portion of the side plate 40*a* of the head mounting frame 40. A pressure adjusting arm 60 is mounted to the mounting bracket 40*b* through a mounting axle 61 so the pressure adjusting arm 60 is pivotal about the amounting axle 61. The holding bracket 40*c* is formed with an arched slot 62, for accepting a holding axle 63 that protrudes sidewise from the pressure adjusting arm 60. A second coiled spring 64 is held between the cam follower plate 51 and the printer frame 42, to urge the head mounting frame 40 to move upward, i.e. in a clockwise direction with respect to the head arm 41. A third coiled spring 65 is held between the pressure adjusting arm 60 and the thermal head 26, to urge the heating element array 26*a* toward the platen roller 27. A cam follower roller 66 is mounted on a top end of the pressure adjusting arm 60, and a pressure changing cam 67 is placed in contact with the cam follower roller 66.

Figure 4:
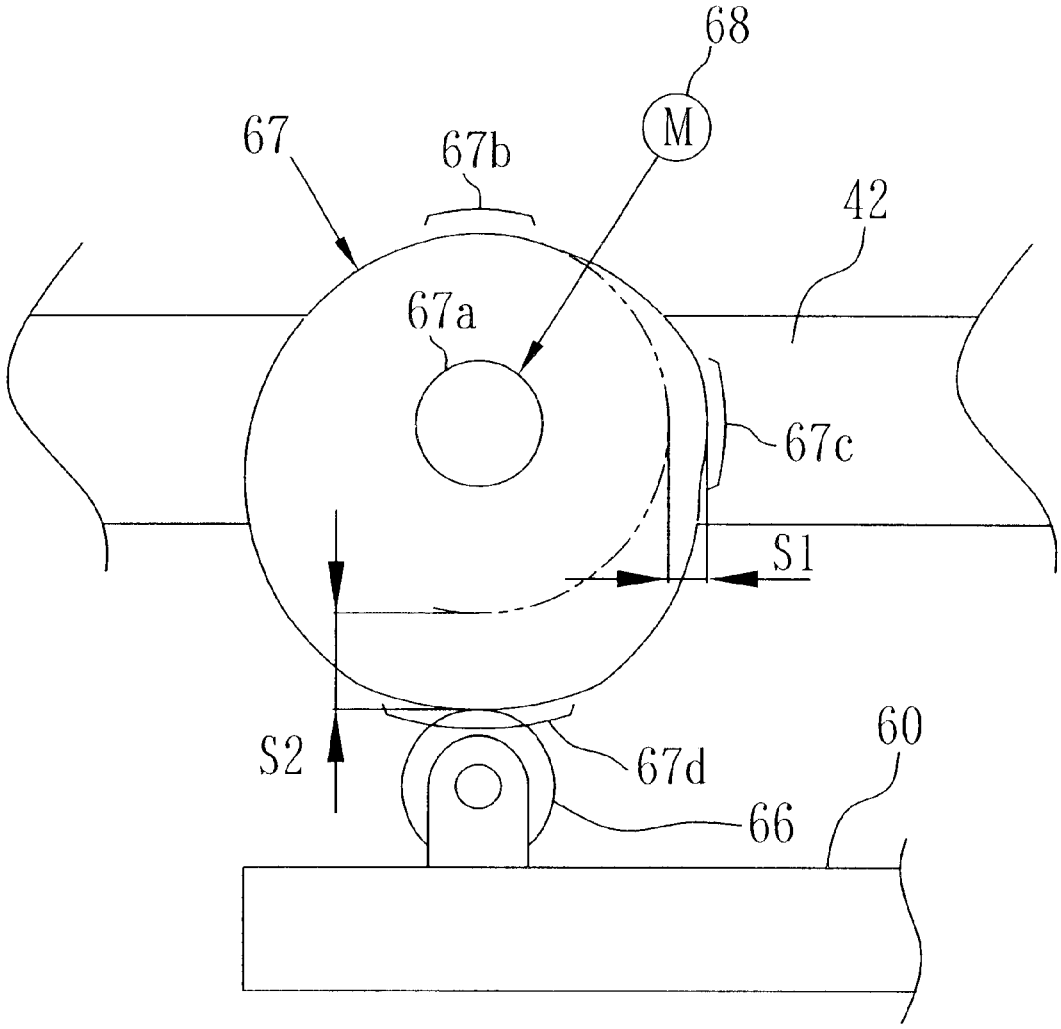
FIG. 4 is an enlarged side view of a vertical position changing cam of a pressure changing mechanism of the first embodiment.

The vertical position changing cam 67 is mounted to the printer frame 42 through a mounting axle 67*a*, and is turned about the axle 67*a* by a motor 68. The vertical position changing cam 67 is also an eccentric cam, as shown in FIG. 4, wherein three surface sections 67*b*, 67*c* and 67*d* are determined respectively for a retracted position, a printing position and a smoothing position of the thermal head 26, those positions are respectively shown in FIGS. 5, 6 and 7.

Specifically, when the first surface section 67*b* is in contact with the cam follower roller 66, the pressure adjusting arm 60 is placed at an uppermost position, where the third coiled spring 65 is not depressed and does not generate any resilient force. Therefore, the head mounting frame is placed at an uppermost position according to the urging force of the second coiled spring 64, bringing the thermal head 26 to the retracted position, where the heating element array 26*a* is set away from the platen roller 27.

Figure 6:
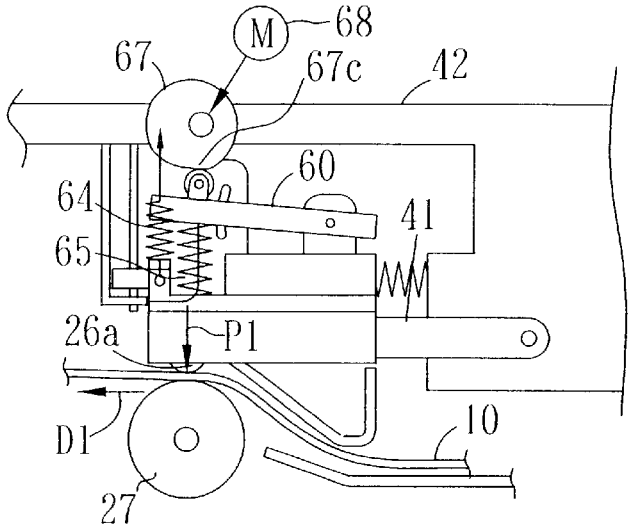
FIG. 6 is an explanatory diagram illustrating the pressure changing mechanism in the printing position.

The second surface section 67*c* protrudes radially by a shift amount S1 as compared to the first surface section 67*b*. Therefore, when the second surface section 67*c* is in contact with the cam follower roller 66, the third coiled spring 65 is depressed by this shift amount S1, so a resilient force is applied from the spring 65 to the head mounting frame 40. As a result, the thermal head 26 is brought into the printing position, where the heating element array 26*a* is pressed with a pressure P1 onto the platen roller 27, as shown in FIG. 6. The shift amount S1 is determined to optimize the pressure P1 for printing.

Figure 7:
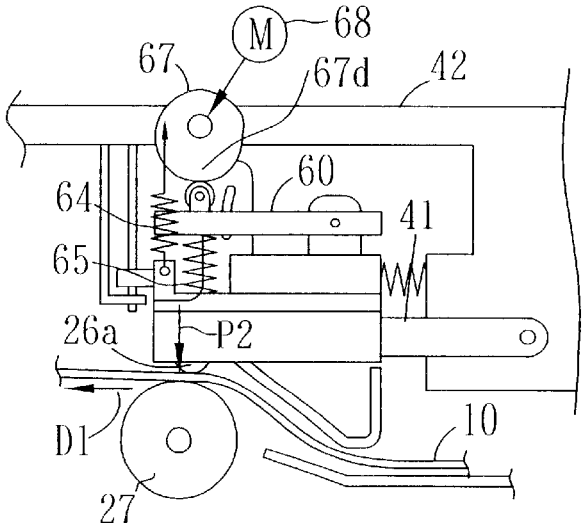
FIG. 7 is an explanatory diagram illustrating the pressure changing mechanism in the smoothing position.

The third surface section 67*d* protrudes radially by a shift amount S2 as compared to the first surface section 67*b*. The shift amount S2 is larger than the shift amount S1. Therefore, when the third surface section 67*d* is in contact with the cam follower roller 66, the third coiled spring 65 is depressed further by this shift amount S2, so a larger resilient force is applied from the spring 65 to the head mounting frame 40. As a result, the thermal head 26 is brought into the smoothing position, where the heating element array 26*a* is pressed with a larger pressure P2 onto the platen roller 27, as shown in FIG. 7. The shift amount S2 is determined to optimize the pressure P2 for smoothing.

The head mounting frame 40, the mounting bracket 40*b*, the holding bracket 40*c*, the pressure adjusting arm 60, the coiled springs 64 and 65, the cam follower rollers 66, the vertical position changing cam 67 and the motor 68 constitute a pressure changing mechanism 69 for the thermal head 26.

Beside the pressure of the heating element array 26*a* being changed by the pressure changing mechanism 69, the horizontal position of the thermal head 26 and thus the horizontal position of the heading element array 26*a* relative to the platen roller 27 is also changed between the printing position and the smoothing position, by the contact position shift mechanism 55. That is, the thermal head 26 is moved to the first horizontal position before the heating element array 26*a* is pressed onto the recording paper 10 in the printing position, as shown in FIG. 2, whereas the thermal head 26 is moved to the second horizontal position before the heating element array 26*a* is pressed onto the recording paper 10 in the smoothing position, as shown in FIG. 3.

Figure 8:
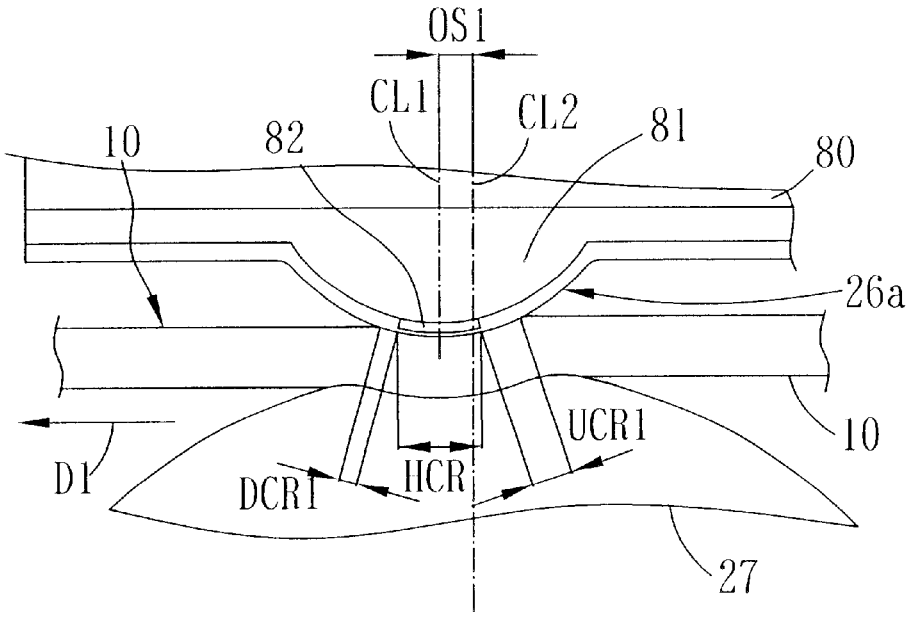
FIG. 8 is an explanatory diagram illustrating a relationship between the thermal head and a platen roller and recording paper in the printing position.
Figure 9:
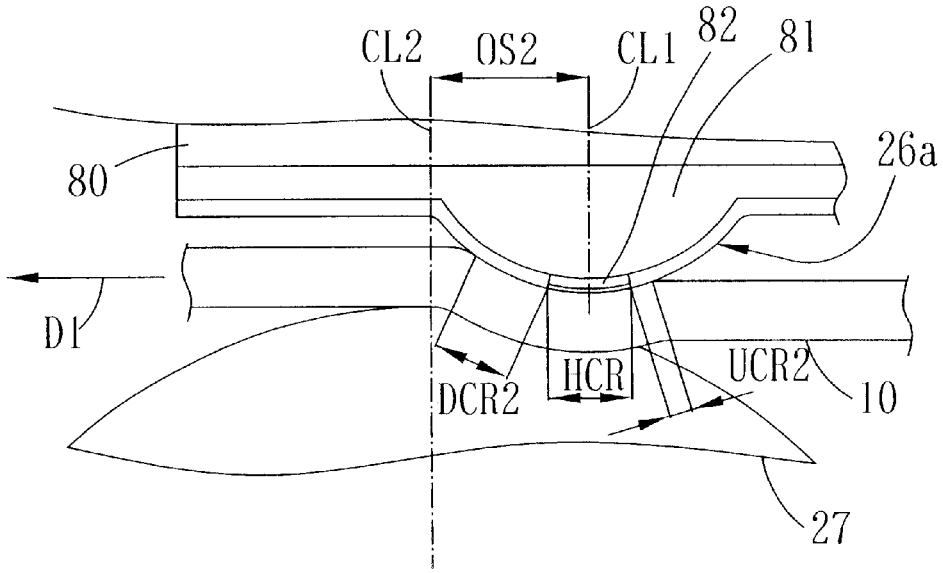
FIG. 9 is an explanatory diagram illustrating a relationship between the thermal head and the platen roller and the recording paper in the smoothing position.

FIGS. 8 and 9 show the relative positions of the heating element array 26*a* to the platen roller 27 in the printing position and the smoothing position respectively. As shown in FIGS. 8 and 9, the heating element array 26*a* is formed along a peak of a semi-cylindrical portion of a glaze layer 81 that is formed on a substrate 80. The peak extends in the widthwise direction of the recording paper 10. That is, the circumferential direction of the semi-cylindrical portion is substantially parallel to the transporting directions D1 and D2 of the recording paper 10. According to this embodiment, a center CL1 of each heating element 82 coincides with the peak or center of the semi-cylindrical portion of the glaze layer 81 in the circumferential direction.

In the first horizontal position and thus in the printing position, as shown in FIG. 8, the center CL1 of the heating element 82 is displaced from a center line CL2 of the platen roller 27, which extends across the rotational center of the platen roller 27 in a perpendicular direction to the substrate 80, by an amount OS1 downstream in the printing direction D1. On the other hand, in the second horizontal position and thus in the smoothing position, as shown in FIG. 9, the center CL1 of the heating element 82 is displaced from the center line CL2 of the platen roller 27 by an amount OS2 upstream in the printing direction D1.

In FIGS. 8 and 9, "HCR" represents a contact range where the recording paper 10 is in contact with the heating elements 82, "UCR1" and "UCR2" represent upstream contact ranges where the recording paper 10 is in contact with the glaze layer 81 preceding the heating element 82, and "DCR1" and "DCR2" represent downstream contact ranges where the recording paper 10 is in contact with the glaze layer 81 following the heating element 82.

Because of the displacement OS1 of the center CL1 of the heating elements 82 from the center line CL2 of the platen roller 27, the downstream contact range DCR1 is shorter than the upstream contact range UCR1 in the printing position. In the smoothing position, on the contrary, the downstream contact range DCR2 is longer than the upstream contact range UCR2, because of the displacement OS2 of the center CL1 from the center line CL2.

Figure 10A:
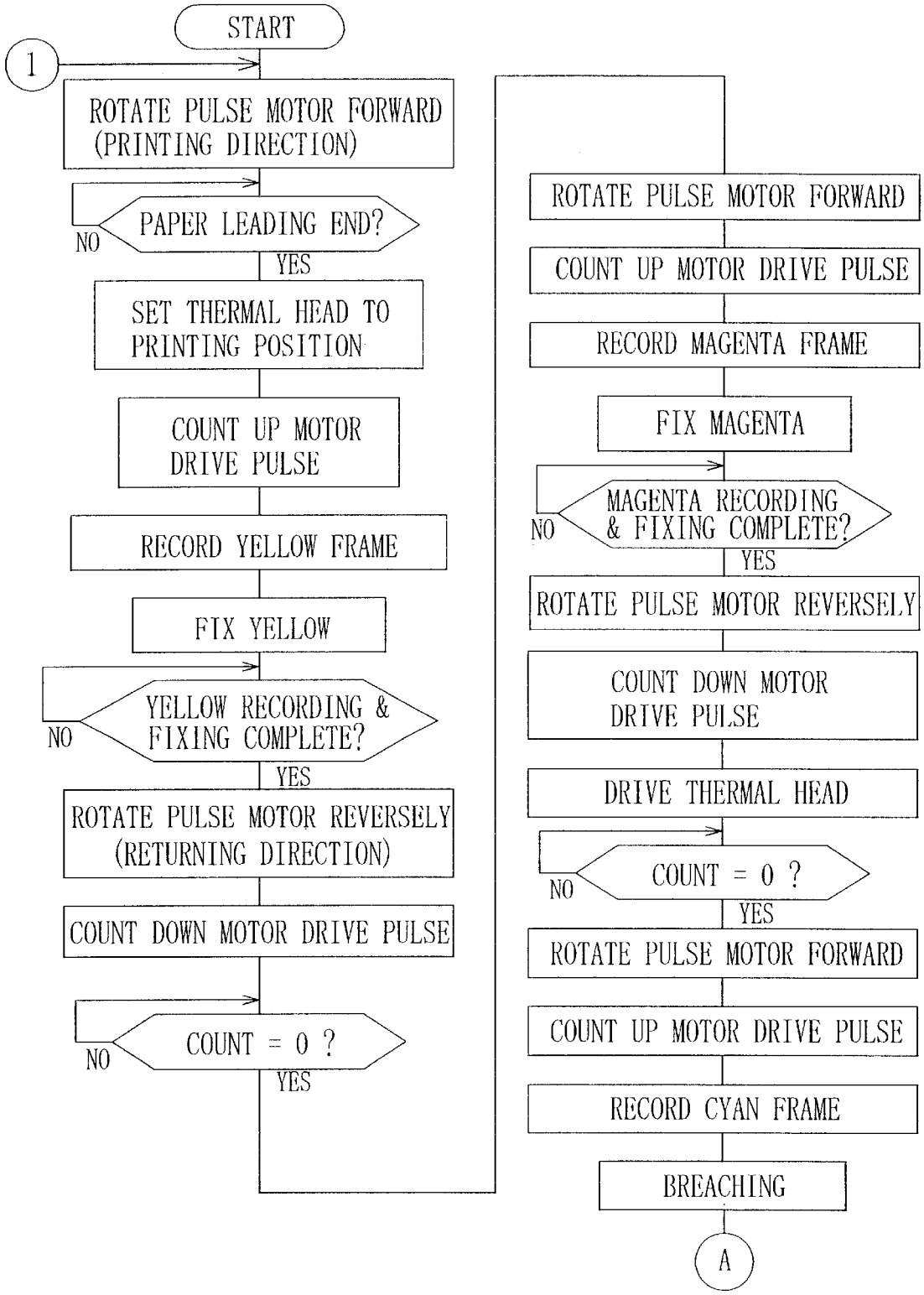
FIGS. 10A and 10B show a flow chart showing the overall operation of the thermosensitive color printer of FIG. 1.
Figure 10B:
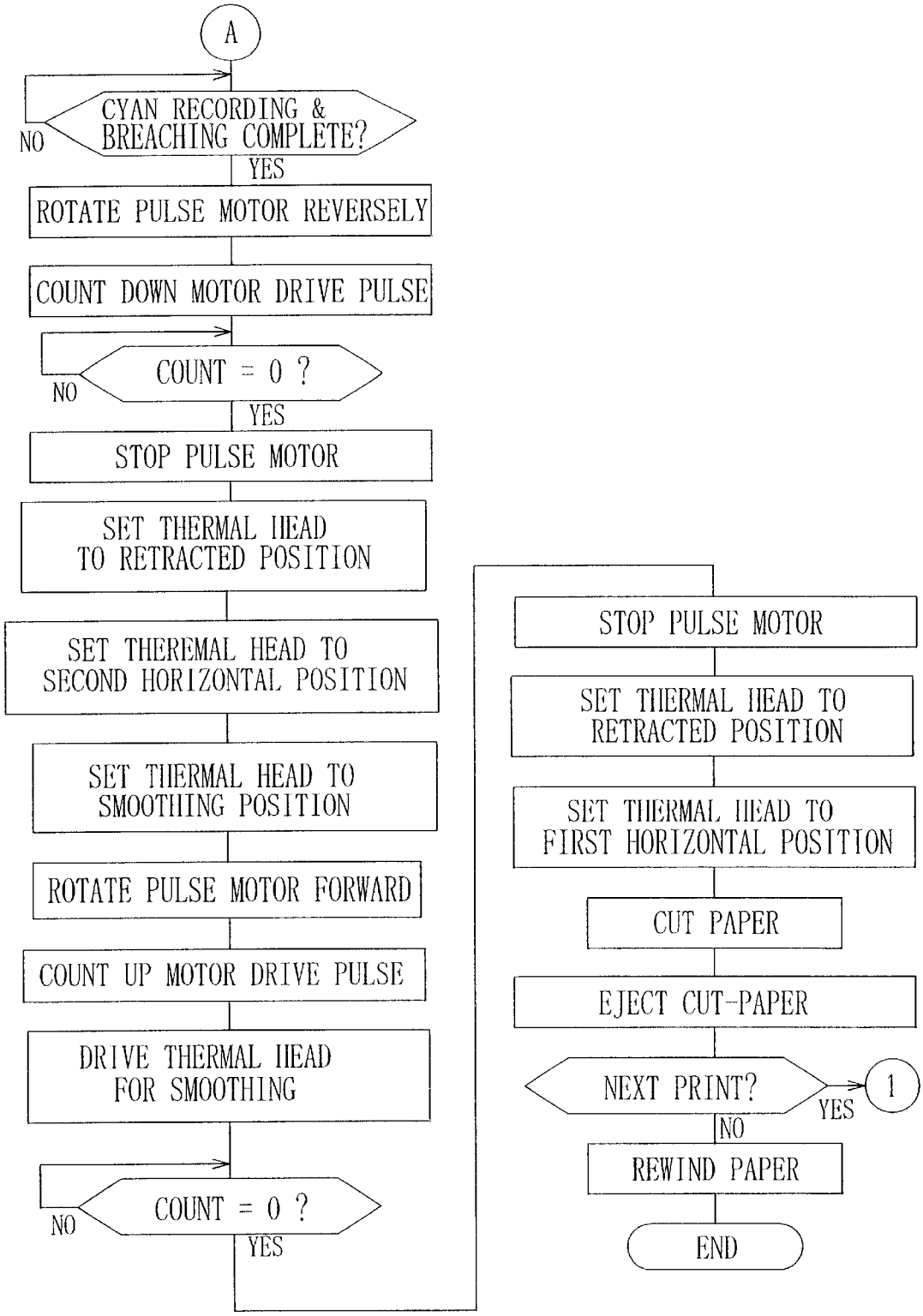

Now, the operation of the thermosensitive color printer 20 will be described with reference to FIGS. 10A and 10B.

Figure 5:
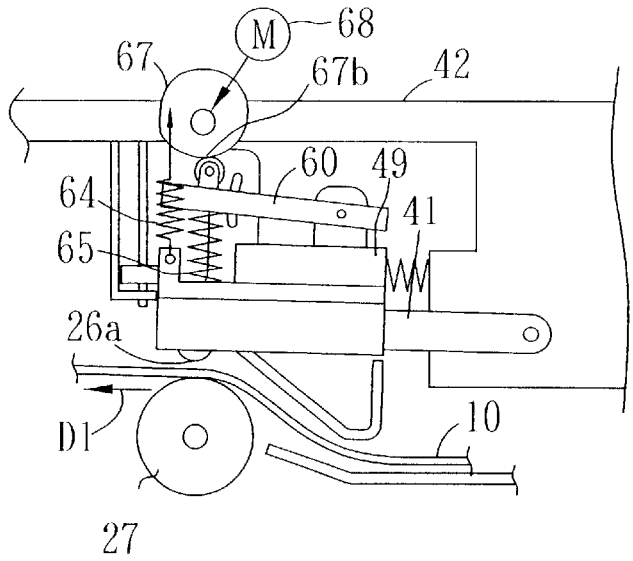
FIG. 5 is an explanatory diagram illustrating the pressure changing mechanism in a retracted position of the thermal head.

In an initial position, the contact position shift mechanism 55 sets the thermal head 26 in the first horizontal position, whereas the pressure changing mechanism 69 sets the thermal head 26 at the retracted position, as shown in FIG. 5, where the first surface section 67*b* of the vertical position changing cam 67 is in contact with the cam follower roller 66. When a not-shown print start key of the keyboard 72 is operated, the pulse motor 31 starts rotating forward, so the paper supply roller pair 24 and the feed roller pair 28 start rotating to feed out the recording paper 10 toward the printing stage 25. After a leading end of the recording paper 25 reaches the feed roller pair 28, the recording paper 10 is nipped between the nip roller 28*b* and the capstan roller 28*a*, and is transported in the printing direction D1 by the feed roller pair 28.

When the paper sensor 29 detects the leading end of the recording paper 10, the system controller 30 drives the motor 68 to bring the second surface section 67*c* of the vertical position changing cam 67 into contact with the cam follower roller 66, so the thermal head 26 is moved to the printing position, pressing the heating element array 26*a* onto the recording paper 10, as shown in FIGS. 6 and 2.

Thereafter, the pulse counter 33 counts up the motor drive pulses applied to the pulse motor 31. The system controller 30 determines based on the count of the pulse counter 33 when to start and stop printing each of the three color frames.

The heating element array 26*a* is first driven in accordance with image data of a first line of the yellow frame. Thereby, heat energies of different amounts are applied to the yellow coloring layer 14 to record yellow pixels of different densities in a line in accordance with the image data of the first line. Other lines of the yellow frame are recorded line by line in the same way on an image recording area of the recording paper 10. While the yellow frame is recorded, the yellow fixing lamp 35*a* is turned on to fix the yellow coloring layer 14.

When the system controller 30 determines based on the count of the pulse counter 33 that the whole image recording area having the yellow frame recorded therein has reached a light projecting area of the yellow fixing lamp 35*a*, and the yellow coloring layer 14 in the image recording area has been fixed, the system controller 30 stops rotating the pulse motor 31 in the forward direction, and starts rotating it reversely to transport the recording paper 10 in the returning direction D2. Then, the pulse counter 33 counts down the motor drive pulses to the pulse motor 31. When the count comes down to zero, the system controller 30 stops the reverse rotation of the pulse motor 31, and starts rotating the pulse motor 31 in the forward direction to feed the recording paper 10 in the printing direction D1 again.

As the recording paper 10 is moved in the printing direction D1, the magenta frame is recorded line by line in the same way as the yellow frame, and the pulse counter 33 counts up the motor drive pulses applied for transporting the recording paper 10 in the printing direction D1. After the magenta frame is completely recorded and the magenta coloring layer 13 is fixed by the magenta fixing lamp 35*b*, the pulse motor 31 is driven to rotate reversely so as to return the recording paper 10 to the same print start position.

The pulse counter 33 counts down the motor drive pulse applied for the reverse rotation, so the recording paper 10 stops at the same print start position by stopping the pulse motor 31 at the timing when the pulse counter 33 counts down to zero.

When the recording paper 10 is returned to the print start position after the magenta frame recording, the system controller 30 starts driving the pulse motor 31 in the forward direction to transport the recording paper 10 in the printing direction D1, while driving the thermal head 26 to record the cyan frame. The cyan coloring layer 12 is not designed to be optically fixed, so it is not necessary to project ultraviolet rays onto the recording paper 10 after the cyan frame recording. However, the magenta fixing lamp 35*b* is turned on during the cyan frame recording, to bleach those parts of the recording paper 10 having no color developed or no image recorded thereon.

After the cyan frame recording and the bleaching are completed, the pulse motor 31 is rotated reversely to move the recording paper 10 back to the print start position. Then, the motor 68 is driven to bring the first surface section 67*b* of the vertical position changing cam 67 into contact with the cam follower roller 66, to set the thermal head 26 back to the retracted position. Next the motor 53 is driven to turn the horizontal position changing cam 52 by 180° degrees, thereby to move the thermal head 26 from the first horizontal position to the second horizontal position. Thereafter, the motor 68 is driven to bring the third surface section 67*d* of the vertical position changing cam 67 into contact with the cam follower roller 66. Thus, the thermal head 26 is moved to the smoothing position, as shown in FIGS. 7 and 3. Then, the motor 31 is driven forwardly to move the recording paper 10 in the printing direction D1, while the thermal head 26 is driven to apply heat energy for smoothing the recording paper 10.

To smooth the recording paper 10, it is necessary to heat the protective layer 15 up above its glass transit temperature and soften the protective layer 15. As described above, the glass transit temperature of the protective layer is dependent upon its components. According to this embodiment, the protective layer 15 uses PVA (poly-vinyl-alcohol) as the main component whose glass transit temperature is about 70° C. This is below the lowest heat energy necessary for recording a dot with the lowest coloring density on the highest sensitive coloring layer of the color recording paper 10, i.e. the yellow coloring layer 14 in this instance. Because the cyan coloring layer 12 is not fixed, the heat energy for the smoothing must be smaller than a value which causes the cyan coloring layer 12 to start coloring.

To control the heat energy applied to the recording paper 10 with accuracy, it is necessary to consider heat accumulation in the thermal head 26. If the pulse duty factor of head drive pulses for driving the thermal head 26, i.e. pulse width per line recording cycle, is too large, the heat accumulation adversely affects the temperature control and results variations in glossiness. If the pulse duty factor is too small and the recording paper 10 is cooled too long, some parts of the protective layer 15 would not be softened so that the obverse surface 10*a* is provided with fine regular undulation at intervals of 1 $\mu$m to 2 $\mu$m because of the difference between softened and not-softened portions. This undulation is detected by organoleptic or sensory tests, and deteriorates the print quality. According to experiments, the pulse duty factor is best at 70% for smoothing.

As described above, since the thermal head 26 is set to the first horizontal position by the contact position shift mechanism 55 before being moved to the printing position by the pressure changing mechanism 69, the center CL1 of the heating elements 82 is displaced by the amount OS1 from the center CL2 of the platen roller 27 to the downstream side in the printing position, as shown in FIG. 8. On the other hand, since the thermal head 26 is set to the second horizontal position by the contact position shift mechanism 55 before being moved to the smoothing position by the pressure changing mechanism 69, the center CL1 of the heating elements 82 is displaced by the amount OS2 from the center CL2 to the upstream side in the smoothing position, as shown in FIG. 9.

Because of the displacement OS1 of the center CL1 of the heating elements 82 from the center line CL2 of the platen roller 27, the downstream contact range DCR1 is shorter than the upstream contact range UCR1 in the printing position, as shown in FIG. 8. Accordingly, the recording paper 10 is not so rapidly cooled by the glaze layer 81 after being heated for recording. This is effective to eliminate unexpected variations in coloring density that would be caused if the recording paper 10 is rapidly cooled after the recording.

In the smoothing position, on the contrary, the downstream contact range DCR2 is longer than the upstream contact range UCR2, as shown in FIG. 9, because of the displacement OS2 of the center CL1 from the center line CL2. Accordingly, the recording paper 10 after being heated for smoothing is rapidly cooled by the glaze layer 81 and the temperature of the protective layer 15 rapidly lowers below its glass transit point, so the protective layer 15 is hardened quickly before it removes off the glaze layer 81. Thus the additives contained in the protective layer 15 are prevented from emerging to the obverse surface 10*a* after the smoothing process. Therefore, the glossiness of the recording paper 10 is improved.

Also during the smoothing, the motor drive pulses for the forward movement of the recording paper 10 is counted up by the pulse counter 33. When the system controller 30 determines based on the count that the image recording area having the full-color image recorded thereon has passed the heating element array 26*a*, the system controller 30 drives the motor 68 of the vertical position changing cam 67 to set the thermal head 26 back to the retracted position. Thereafter, the motor 53 of the contact position shift mechanism 55 is driven to move the thermal head 26 back to the first horizontal position.

When it is determined based on the count that the recording paper 10 is positioned at an appropriate cutting position, the paper cutter 36 is activated to cut the image recording area having the full-color image recorded thereon off the other portion of the recording paper 10. The cut piece of recording paper 10 is ejected through the paper ejection roller pair 37. To print the next image, the pulse motor 31 is rotated forward to transport a new leading end of the recording paper 10 to the printing stage 25, and the same processes as above are executed. When the printer 20 is deactivated, the leading end of the recording paper 10 is rewound into the paper roll chamber 23 by rotating the pulse motor 31 reversely.

In the above embodiment, the center CL1 of the heating element array 26*a* is horizontally displaced from the center CL2 of the platen roller 27 with respect to the horizontal paper transporting directions, in order to shift the contact ranges of the recording paper 10 with the glaze layer 81 between the printing position and the smoothing position. In alternative, the contact ranges of the recording paper 10 with the glaze layer 81 may be shifted by changing the contact angle of the heating element array 26*a* with the platen roller 27 relative to the paper transporting directions.

Figure 11:
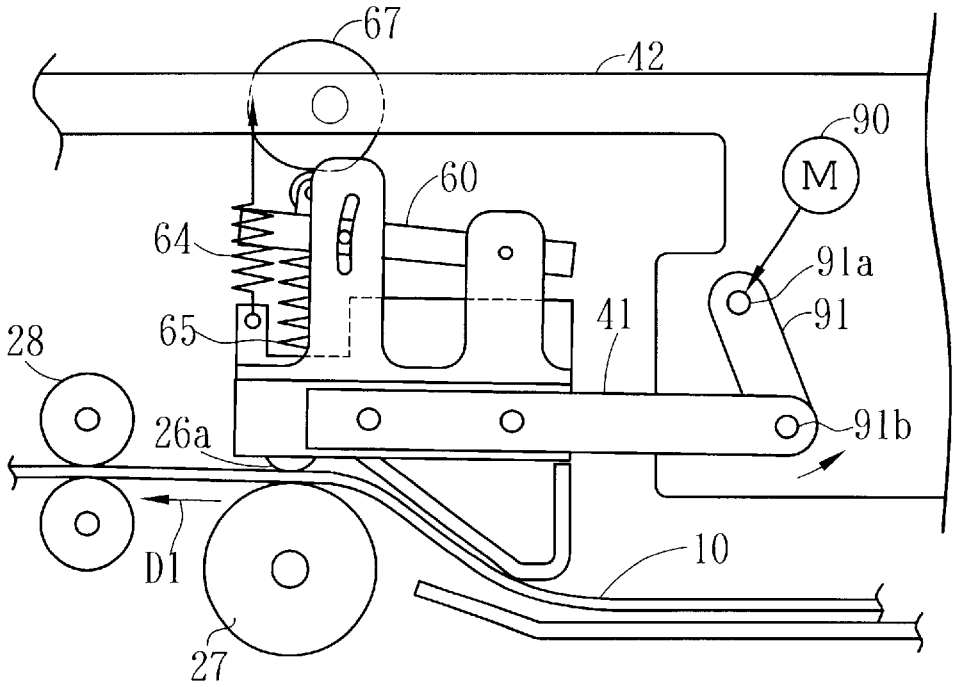
FIG. 11 is a schematic diagram illustrating a contact position shift mechanism in a printing position according to a second embodiment of the invention.
Figure 12:
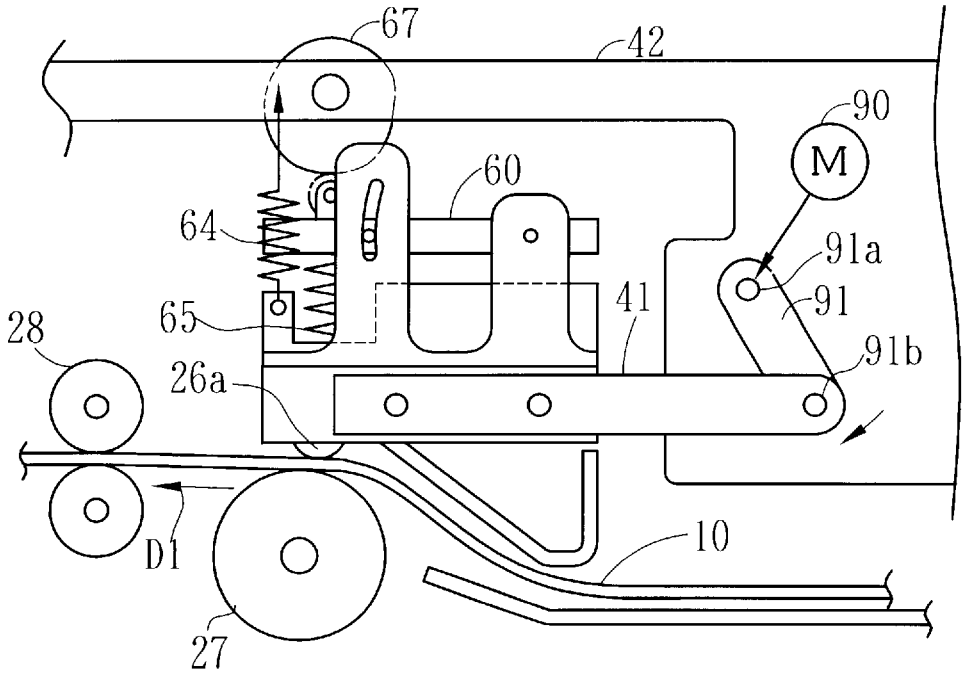
FIG. 12 is a schematic diagram illustrating the contact position shift mechanism of the second embodiment in a smoothing position.

For instance, as shown in FIGS. 11 and 12, the head arm 41 may be amounted to the printer frame 42 through a swing arm 91 that is pivotally mounted to the printer frame 42 through a mounting axle 91*a*. The head arm 41 is pivotally coupled to a distal end of the swing arm 91 through an axle 91*b*. The swing arm 91 swings as a motor 90 coupled thereto through the mounting axle 91*a* is driven. As a result, the head arm 41 is inclined relative to the horizontal direction, so the contact angle as well as the contact position of the heating element array 26*a* with the platen roller 27 is changed between a printing position as shown in FIG. 11 and a smoothing position as shown in FIG. 12. The contact ranges of the recording paper 10 with the glaze layer 81 as well as the pressure from the heating element array 26*a* onto the recording paper 10 are optimized for printing in the printing position of FIG. 11, and for smoothing in the smoothing position of FIG. 12.

Figure 13A:
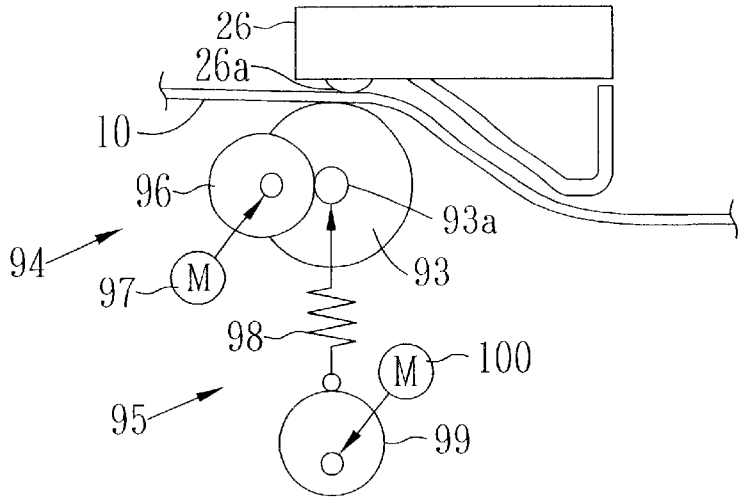
FIG. 13A is an explanatory diagram illustrating a third embodiment of the invention in a smoothing position, wherein a thermal head is immovable and a platen roller is moved to change the contact position and the pressure of the thermal head on the platen roller.
Figure 13B:
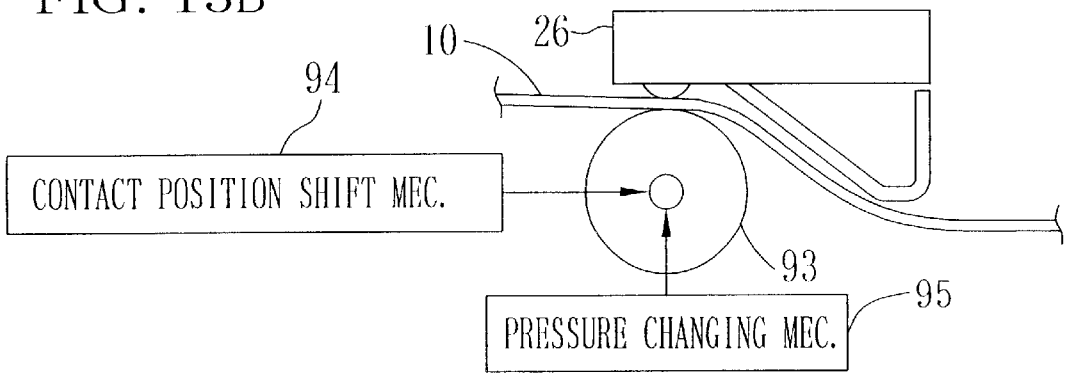
FIG. 13B is an explanatory diagram illustrating the third embodiment in a printing position.
Figure 13C:
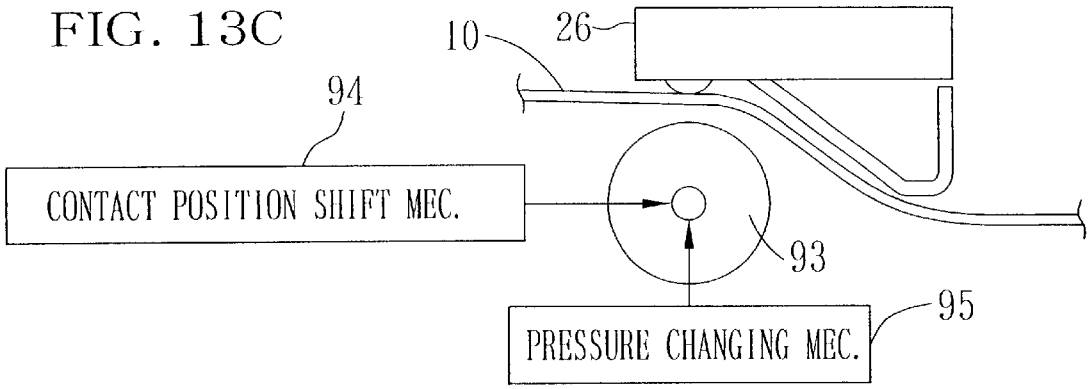
FIG. 13C is an explanatory diagram illustrating the third embodiment in a retracted position.

It is also possible to change the contact position and the pressure of the heating element array 26*a* on the recording paper 10 by shifting the position of the platen roller 27 instead of the thermal head 26, as shown for instance in FIGS. 13A to 13C. In that case, the thermal head 26 is mounted immovable, whereas a platen roller 93 is mounted movable through a contact position shift mechanism 94 and a pressure changing mechanism 95. The contact position shift mechanism 94 shifts a mounting axle 93*a* of the platen roller 93 in a horizontal direction parallel to the recording paper 10 transported through between the platen roller 93 and the thermal head 26, and is constituted of an eccentric cam 96 and a motor 97. The pressure changing mechanism 95 shifts the mounting axle 93*a* of the platen roller 93 in a vertical direction to the recording surface of the recording paper 10, and is constituted of a coiled spring 98, an eccentric cam 99 and a motor 100.

It is possible to shift the positions of both the thermal head and the platen roller to change the contact position and the pressure of the heating element array on the platen roller and thus on the recording paper. The mechanisms for shifting the position of the thermal head or the platen roller are not limited to the above embodiments, but may be conventional position shift mechanisms consisting of linkages and gears.

It is possible to rotate the capstan roller 28*a* in place of the pulse motor 31. In that case, a pulse encoder is mounted on an axle of the capstan roller 28*a* to generate encode pulses representative of the number of rotations of the platen roller, and control the DC motor based on the count of the encode pulses.

It is possible to fix the yellow or magenta coloring layer while the recording paper is transported in the returning direction D2. It is also possible to effect the fixing process in the opposite directions D1 and D2. The position of the yellow fixing lamp and the magenta fixing lamp may be changed with each other.

Although each color frame is recorded as the recording paper is transported in the same direction D1 in the above embodiment, it is possible to record the second color frame, i.e. the magenta frame in this instance, while transporting the recording paper in the returning direction D2. It is also possible to effect smoothing while transporting the recording paper in the returning direction D2. In any case, the contact position of the heating elements for smoothing is to be shifted to an upstream side in the paper transporting direction during the smoothing.

Although the thermosensitive color recording paper has three kinds of coloring layers, the present invention is applicable to those printers which use thermosensitive color recording paper that have more than three coloring layers.

Although the present invention has been described with respect to the capstan-driven type thermosensitive printer, the present invention is applicable to a platen-driven type thermosensitive printer where the platen roller is driven by a motor to transport the recording paper. The present invention is also applicable to those printers which uses cut sheets of recording paper instead of the continuous web of recording paper withdrawn from a paper roll. In that case, each sheet of recording paper may be conveyed on a large diameter platen drum that makes three revolutions for each full-color image.

Thus, the present invention is not to be limited to the above embodiments but, on the contrary, various modifications may be possible to those skilled in the art without departing from the scope of claims appended hereto.

What is claimed is:

1. A thermosensitive color printing method of printing a full-color image on thermosensitive color recording paper having a plurality of coloring layers formed on atop another and a heat resistant protective layer formed on an obverse surface, the coloring layers having decreasing heat-sensitivities from the obverse side to develop different colors from each other, the method comprising the steps of:

A. recording different color frames of the full-color image line by line on the respective coloring layers sequentially from the obverse side by pressing an array of heating elements of a thermal head onto the obverse surface of the thermosensitive color recording paper and heating the recording paper by the heating elements while supporting the thermosensitive color recording paper from a reverse side by a platen member and transporting the recording paper through between the thermal head and the platen roller;

B. fixing an upper one of the coloring layers optically before recording on the next coloring layer by projecting rays of a specific wavelength range onto the thermosensitive recording paper;

C. transporting the thermosensitive color recording paper, after having the full-color image recorded thereon, while pressing the heating elements onto the obverse surface of the recording paper with a higher pressure than during the step A; and D. heating the thermosensitive color recording paper, during the step C, by the heating elements to an extent predetermined for smoothing the protective layer.

2. The method of claim 1, wherein the method is performed using a single thermal head.

3. A thermosensitive color printing method of printing a full-color image on thermosensitive color recording paper having a plurality of coloring layers formed on atop another and a heat resistant protective layer formed on an obverse surface of the thermosensitive color recording paper, the coloring layers having decreasing heat-sensitivities from the obverse side to develop different colors from each other, the method comprising the steps of:

A. recording different color frames of the full-color image line by line on the respective coloring layers sequentially from the obverse side by pressing an array of heating elements of a thermal head onto the obverse surface of the thermosensitive color recording paper and heating the recording paper by the heating elements while supporting the thermosensitive color recording paper from a reverse side by a platen roller and transporting the recording paper back and forth along a paper transport path that extends perpendicularly to the array of heating elements;

B. fixing one color frame optically before recording the next color frame by projecting rays of a specific wavelength range onto the thermosensitive recording paper;

C. transporting the thermosensitive color recording paper, after having the full-color image recorded thereon, in one direction along the transport path while pressing the heating elements onto the obverse surface of the recording paper at a position that is shifted from a contact position of the heating elements in the step A relative to the platen roller, to an upstream side with respect to the paper transporting direction in the step C; and D. heating the thermosensitive color recording paper by the heating elements to an extent predetermined for smoothing the protective layer during the step C.

4. A thermosensitive color printing method as claimed in claim 3, wherein the heating elements are pressed onto the obverse surface of the thermosensitive color recording paper with a higher pressure during the step C than during the step A.

5. A thermosensitive color printing method as claimed in claim 3 or 4, wherein the contact position of the heating elements is shifted by shifting a relative position of the thermal head to the platen roller in parallel to the paper transport path.

6. A thermosensitive color printing method as claimed in claim 3 or 4, wherein the contact position of the heating elements is shifted by changing a contact angle of the heating elements of the thermal head on the platen roller relative to a direction parallel to the paper transport path.

7. A thermosensitive color printing method as claimed in claim 3 or 4, wherein the heating elements are formed along a peak of a semi-cylindrical glaze layer, whereas a contact point of the platen roller with the glaze layer in the step C is displaced downstream from a center of each heating element in the paper transport direction in the step C.

8. The method of claim 3, wherein the method is performed using a single thermal head.

9. A thermosensitive color printer for printing a full-color image on thermosensitive color recording paper having a plurality of coloring layers formed on atop another and a heat resistant protective layer formed on an obverse surface of the thermosensitive color recording paper, the coloring layers having decreasing heat-sensitivities from the obverse side to develop different colors from each other, wherein different color frames of the full-color image are recorded on the respective coloring layers sequentially from the obverse side by heating the recording paper and then fixing one color frame optically before recording the next color frame, the printer comprising:

a thermal head having an array of heating elements, the heating elements being pressed onto the obverse surface of the thermosensitive color recording paper to heat the recording paper;

a platen roller opposed to the array of heating elements, for supporting the recording paper from a reverse side;

a transporting device for transporting the thermosensitive color recording paper along a paper transport path that extends perpendicularly to the array of the heating elements;

a driving device for driving the heating elements to heat the thermosensitive color recording paper as it is transported along the paper transport path, for recording the full-color image and thereafter for smoothing the protective layer;

an optical fixing device for projecting optical fixing rays onto the thermosensitive recording paper;

a pressure changing device for changing pressure from the heating elements to the recording paper between a lower value for recording and a higher value for smoothing; and a contact position shifting device for shifting the position of the heating elements pressed on the recording paper between a first contact position and a second contact position that is located at an upstream side of the first position in the paper transporting direction during the smoothing.

10. A thermosensitive color printer as claimed in claim 9, wherein the array of heating elements is formed along a peak of a semi-cylindrical glaze layer, whereas a contact point of the platen roller with the glaze layer is displaced downstream from a center of each heating element in the paper transport direction for the smoothing.

11. A thermosensitive color printer as claimed in claim 9, wherein the contact position shifting device comprises a mechanism for shifting the thermal head or the platen roller in a direction parallel to the paper transport path.

12. The thermosensitive color printer as claimed in claim 11, wherein the contact position shifting device comprises a coil disposed at a first side of the thermal head and a cam disposed at a second side of the thermal head, said second side being opposite the first side, and said cam being selectively engaged in at least one of the first and second positions to compress and decompress said coil.

13. A thermosensitive color printer as claimed in claim 9, wherein the contact position shifting device comprises a mechanism for changing a contact angle of the heating elements on the platen roller relative to a direction parallel to the paper transport path.

14. A thermosensitive color printer as claimed in claim 9, wherein the pressure changing device comprises a mechanism for shifting the thermal head or the platen roller in a direction vertical to the paper transport path.

15. The thermosensitive color printer as claimed in claim 9, wherein the contact position shifting device comprises a coil disposed at a first side of the thermal head and a cam disposed at a second side of the thermal head, said second side being opposite the first side, and said cam being selectively engaged in at least one of first and second positions to compress and decompress said coil.

16. The thermosensitive color printer as claimed in claim 9, wherein the pressure changing device comprises a coil disposed above the thermal head and a cam disposed over said thermal head, said cam being selectively engaged in at least one of first and second positions to compress and decompress said coil.

* * * * *